US006046737A

United States Patent [19]

Nakamura

[11] Patent Number: 6,046,737

[45] **Date of Patent: *Apr. 4, 2000**

[54] DISPLAY DEVICE WITH A DISPLAY MODE IDENTIFICATION FUNCTION AND A DISPLAY MODE IDENTIFICATION METHOD

[75] Inventor: Masanori Nakamura, Kawasaki, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/690,072

[22] Filed: Jul. 31, 1996

[30] Foreign Application Priority Data

Feb. 14, 1996 [JP] Japan ..... 8-026741

[51] Int. Cl.[7] ..... G09G 5/00

[52] U.S. Cl. ..... 345/213; 345/3

[58] Field of Search ..... 345/213, 204, 345/1, 3, 132, 211, 212, 214, 148, 150; 348/511, 536, 554, 588, 476, 473

[56] References Cited

U.S. PATENT DOCUMENTS

| | | | |
|---|---|---|---|
| 4,991,023 | 2/1991 | Nicols | 345/213 |
| 5,231,389 | 7/1993 | Yamauchi | 345/213 |

FOREIGN PATENT DOCUMENTS

| | | | |
|---|---|---|---|
| 3-7987 | 1/1991 | Japan | 345/3 |
| 6-259040 | 9/1994 | Japan . | |
| 96-3421 | 1/1996 | Rep. of Korea . | |

*Primary Examiner*—Chanh Nguyen
*Attorney, Agent, or Firm*—Greer, Burns & Crain, Ltd.

[57] ABSTRACT

The present invention relates to a display device and a method for identifying a display mode for a display device which receives a synchronous signal and a video signal. The display device measures a frequency or cycle of the synchronous signal, compares the measured frequency or cycle of the synchronous signal with a reference frequency or cycle to identify the display mode, and changes the reference frequency or cycle including a first and second reference value selectively for the step of comparing. According to the present invention, the display mode is stably identified.

13 Claims, 11 Drawing Sheets

MODE IDENTIFICATION SECTION

FIG. 2
SIGNALS RELATIONSHIP FOR MODE IDENTIFICATION

| COMPARISON SIGNAL 1 | COMPARISON SIGNAL 2 | COMPARISON SIGNAL 3 | MODE 1 | MODE 2 | MODE |
|---|---|---|---|---|---|
| L | L | L | L | L | A |
| H | L | L | L | H | B |
| H | H | L | H | L | C |
| H | H | H | H | H | D |

FIG. 3
REFERENCE FREQUENCIES (CYCLES)

| | MODE | Hs FREQUENCY (Cycle) | REFERENCE VALUE FIRST REFERENCE (Cycle) | REFERENCE VALUE SECOND REFERENCE (Cycle) |
|---|---|---|---|---|
| Hs×1 | MODE A | 37.861KHz(26.413μs) | 36.374KHz(27.492μs) | 37.048KHz(26.992μs) |
| | MODE B | 35.000KHz(28.571μs) | 33.141KHz(30.175μs) | 33.698KHz(29.675μs) |
| | MODE C | 31.469KHz(31.778μs) | 27.755KHz(36.029μs) | 28.146KHz(35.529μs) |
| | MODE D | 24.826KHz(40.280μs) | | |
| Hs×1/2 | MODE A | 18.931KHz(52.826μs) | FIRST REFERENCE (Cycle) 18.187KHz(54.984μs) | SECOND REFERENCE (Cycle) 18.524KHz(53.984μs) |
| | MODE B | 17.500KHz(57.142μs) | 16.571KHz(60.350μs) | 16.849KHz(59.350μs) |
| | MODE C | 15.735KHz(63.556μs) | 13.878KHz(72.058μs) | 14.073KHz(71.058μs) |
| | MODE D | 12.413KHz(80.560μs) | | |

FIG. 4
REFERENCE FREQUENCY FOR MODE IDENTIFICATION

| | FIRST REFERENCE FREQUENCY | | | SECOND REFERENCE FREQUENCY | | |
|---|---|---|---|---|---|---|
| | FREQUENCY | CYCLE | COUNT | FREQUENCY | CYCLE | COUNT |
| REFERENCE 1 | 36.374KHz | 27.492μs | 550 | 37.048KHz | 26.992μs | 540 |
| REFERENCE 2 | 33.141KHz | 30.175μs | 604 | 33.698KHz | 29.675μs | 594 |
| REFERENCE 3 | 27.755KHz | 36.029μs | 721 | 28.146KHz | 35.529μs | 711 |

(MCLK : 20MHz)

LCD CONTROLLER

MODE IDENTIFICATION SECTION

FIG. 7
REFERENCE FREQUENCY FOR MODE IDENTIFICATION

| | FIRST REFERENCE | | | UNSTABLE REGION | SECOND REFERENCE | | |
|---|---|---|---|---|---|---|---|
| | FREQUENCY | CYCLE | COUNT | | FREQUENCY | CYCLE | COUNT |
| REFERENCE 1 | 36.374KHz | 27.492 μs | 550 | 546 ~ 554 | 37.048KHz | 26.992 μs | 540 |
| REFERENCE 2 | 33.141KHz | 30.175 μs | 604 | 600 ~ 608 | 33.698KHz | 29.675 μs | 594 |
| REFERENCE 3 | 27.755KHz | 36.029 μs | 721 | 717 ~ 725 | 28.146KHz | 35.529 μs | 711 |

(MCLK : 20MHz)

MODE IDENTIFICATION SECTION

DISPLAY SIGNALS

PRIOR ART
FIG. 10
DISPLAY MODES

| ITEMS \ MODE | | A | B | C | D |
|---|---|---|---|---|---|
| DOT CLOCK FREQUENCY | MHz | 31.500 | 30.240 | 25.175 | 21.053 |
| HSFREQUENCY | KHz | 37.861 | 35.000 | 31.469 | 24.826 |
| HSCYCLE | μs | 26.413 | 28.571 | 31.778 | 40.280 |
| HTOTAL | DOT | 832 | 864 | 800 | 848 |
| HDISP | DOT | 640 | 640 | 640 | 640 |
| HBP | DOT | 128 | 96 | 48 | 85 |
| HW | DOT | 40 | 64 | 96 | 64 |
| HFP | DOT | 24 | 64 | 16 | 59 |
| VSFREQUENCY | Hz | 72.81 | 66.67 | 59.94 | 56.42 |
| VSCYCLE | ms | 13.73 | 15.00 | 16.68 | 17.72 |
| VTOTAL | HsNo. | 520 | 525 | 525 | 440 |
| VDISP | HsNo. | 480 | 480 | 480 | 400 |
| VBP | HsNo. | 28 | 39 | 33 | 25 |
| VW | HsNo. | 3 | 3 | 2 | 8 |
| VFP | HsNo. | 9 | 3 | 10 | 7 |

PRIOR ART

FIG. 11

FREQUENCY OF Hs IDENTIFICATION

| MODE | FREQUENCY (Cycle) | REFERENCE VALUE |
|---|---|---|
| MODE A | 37.861KHz(26.413 μs) | |
| | | REFERENCE FREQ 36.374KHz(27.492 μs) |
| MODE B | 35.000KHz(28.571 μs) | |
| | | REFERENCE FREQ. 33.141KHz(30.175 μs) |
| MODE C | 31.469KHz(31.778 μs) | |
| | | REFERENCE FREQ. 27.755KHz(36.029 μs) |
| MODE D | 24.826KHz(40.280 μs) | |

DISPLAY DEVICE WITH A DISPLAY MODE IDENTIFICATION FUNCTION AND A DISPLAY MODE IDENTIFICATION METHOD

BACKGROUND OF THE INVENTION

1. Field of the Invention

The present invention relates to a display device which receives video signals from a computer in various modes, and displays them in accordance with the display modes; and in particular to a display device which can provide a stable display and to a display operational mode identification method.

2. Related Arts

Generally, a computer, such as a personal computer, supplies to a display device display signals, such as red, green and blue (RGB) video signals, horizontal synchronous signals and vertical synchronous signals. The display device thereafter displays predetermined images in accordance with the received display signals.

FIG. 9 is a signal waveform diagram for explaining the outline of such display signals. In FIG. 9 are shown the relationships between a video signal, a horizontal synchronous signal $H_S$, and a vertical synchronous signal $V_S$. The horizontal synchronous signal $H_S$ is a signal wherein a pulse signal having a pulse width $H_W$ is repeated at a predetermined cycle. A video signal is inserted between the pulses at a specified timing. $H_{BP}$ represents a back-porch period, and $HF_{FP}$ represents a front-porch period. A video signal is inserted during a period of $H_{DSP}$.

The vertical synchronous signal $V_S$ is a pulse signal that is generated, in a display mode for 480 lines for example, each time the video signal is inserted between the horizontal synchronous signal, $H_S$ is transmitted 480 times for 480 lines. $V_W$ represents a pulse width, $V_{BP}$ represents a back-porch period, and $V_{FP}$ represents a front-porch period. The horizontal synchronous signal $H_S$ for 480 cycles is inserted into the display period $V_{DSP}$ between the back-porch period $V_{BP}$ and the front-porch period $V_{FP}$.

A display device receiving these display signals, for example a dot-matrix display device such as a liquid crystal display panel or a plasma display panel, internally generates a timing by using the received vertical synchronous signal $V_S$ and the horizontal synchronous signal $H_S$, obtains a video signal for each pixel by sampling the received video signal in synchronous to the timing, and drives the display panel according to the video signals. Therefore, the display device can not correctly display an image that a computer intended, so long as the display device does not recognize, as timing data, the frequency (cycle), pulse width $H_W$, front-porch period $H_{FP}$, back-porch period $H_{BP}$, display signal period $H_{DSP}$ for the horizontal synchronous signal $H_S$, and the frequency (cycle) and the periods $V_W$, $V_{FP}$, $V_{BP}$ and $V_{DSP}$ of the vertical synchronous signal $V_S$.

FIG. 10 is a table showing a plurality of display modes. Display signals supplied to the display device are generated according to these display modes in accordance with the computer types. Such operational modes are, for example, the modes A through D shown in FIG. 10. Although there are various other display modes, an explanation will be given for this specification by using the above four display modes as examples.

The frequencies (cycles) of the horizontal synchronous signals $H_S$ and vertical synchronous signals $V_S$ differ in these display modes. Accordingly, the frequency of a dot clock is also different in the modes at which the display device performs sampling of a video signal for each pixel. As a result, the display periods, the front-porch periods, the back-porch periods, etc., are also different in the modes. It is, therefore, required that the display device understands exactly to which display mode the supplied display signals correspond.

However, neither a dot clock nor information concerning which operational mode is used is supplied by the computer to the display device. Thus, the display device must detect the frequency of the horizontal synchronous signal $H_S$ and/or of the vertical synchronous signal $V_S$, and determine which display mode is being used by referring to one or both frequencies. In accordance with the determination, the display device internally generates a timing signal, such as the dot clock signal, and performs sampling of the received video signal at the timing to display a pixel for an image.

FIG. 11 is a table for explaining how the frequency of the horizontal synchronous signal $H_s$ is identified. According to the most general identification method, the intermediate value of the frequency (cycle) of each display mode is set as a reference value for identification, and the display mode is identified by determining whether the signal frequency is higher or lower than the reference value.

In other words, when the horizontal synchronous signal to be supplied has a frequency greater than the reference frequency 1, or has a cycle smaller than that of the reference frequency 1, the display mode is determined to be mode A. When the frequency of the horizontal synchronous signal is located between the reference frequencies 1 and 2, the display mode is determined to be mode B. When the frequency of the horizontal synchronous signal is positioned between reference frequencies 2 and 3, display mode is the determined to be mode C. When the frequency of the horizontal synchronous signal is lower than the reference frequency 3, the display mode is determined to be mode D.

A part of computers, however, sometimes supply a display signal with a frequency that is very far from the frequency of the mode shown in FIG. 10 or the similar frequency thereto. The worst case is when the display signal is supplied with a frequency that is near the reference frequency for identification set in FIG. 11. In this case, the identification of the display mode at a mode identification section is unstable, and each time the mode is identified, the mode may be determined as, for example, mode A or mode B. As a result, the size of a screen display is increased or reduced, or the screen is vibrated from side to side. In the worst case, a PLL circuit for generating a dot clock signal from a horizontal synchronous signal frequently goes into an unlock state and the screen display is degraded.

SUMMARY OF THE INVENTION

It is therefore one object of the present invention to provide a display device that can stably identify a display operational mode and prevent the degradation of a screen display, and a display operational mode identification method therefor.

It is another object of the present invention to provide a display device that can select the identification reference value for a display operational mode and can provide a display in an optimal display operational mode, and a display mode identification method therefor.

It is an additional object of the present invention to provide a display device that automatically selects an optimal reference value as the identification standard for a display operational mode, and can provide a display in an optimal and steady display mode, and a display operational mode identification method.

The present invention relates to a display device having a display operational mode identification function which receives display signals including at least a horizontal synchronous signal, a vertical synchronous signal and a video signal transmitted at a predetermined timing relative to the horizontal and vertical synchronous signals, analyzes the horizontal and the vertical synchronous signals to identify a display operational mode that specifies the predetermined timing, and displays the video on a display screen. The display device comprises an identification section for measuring a frequency or a cycle of the synchronous signal, and for comparing the frequency or the cycle with a predetermined reference frequency or cycle to identify the display operational mode. The identification section can change the reference frequency or cycle.

With this arrangement, when any synchronous signals are supplied, a predetermined reference frequency value can be selectively used to stabilize the mode identification. Thus, the screen display is not degraded.

With respect to the above reference frequency, a middle value (preferably, a value in the middle) between frequencies of the horizontal signals corresponding to the individual modes is set as a first reference value, and a frequency higher or lower than the first reference value is set as a second reference value, so that the reference frequency can be switched between the first and the second values easily. Since when the frequency of a received synchronous signal is near the first reference value, the second reference value is automatically selected, these reference values can be automatically switched. Furthermore, a plurality of reference values may be prepared. And in addition, when the frequency of the supplied synchronous signal is positioned near the middle value, an arbitrary display operational mode can be forcibly set through selecting the second reference.

Further, to achieve the above objects, according to the present invention, a method for measuring a frequency of an input horizontal synchronous signal or of a vertical synchronous signal to identify a display mode for a display signal is provided. In such a method at least two reference signals having different reference frequencies are employed. And when it is impossible or unstable to perform a display mode identification by comparing the reference frequency of one of the reference signals with the frequency of the synchronous signal, the reference frequency of the other reference signal is compared with the frequency of the synchronous signal to stably identify the display operational mode.

BRIEF DESCRIPTION OF THE DRAWINGS

FIG. 2 is a table showing relationships between signals for operational mode identification;

FIG. 3 is a table for explaining reference frequencies for operational mode identification;

FIG. 4 is a table for explaining reference frequencies for operational mode identification;

FIG. 7 is a table for explaining reference frequencies for operational mode identification;

FIG. 10 is a table for a plurality of display modes; and

FIG. 11 is a table for explaining the identification process using the frequency of a horizontal synchronous signal $H_S$.

DETAILED DESCRIPTION OF THE PREFERRED EMBODIMENTS

Figure 1:
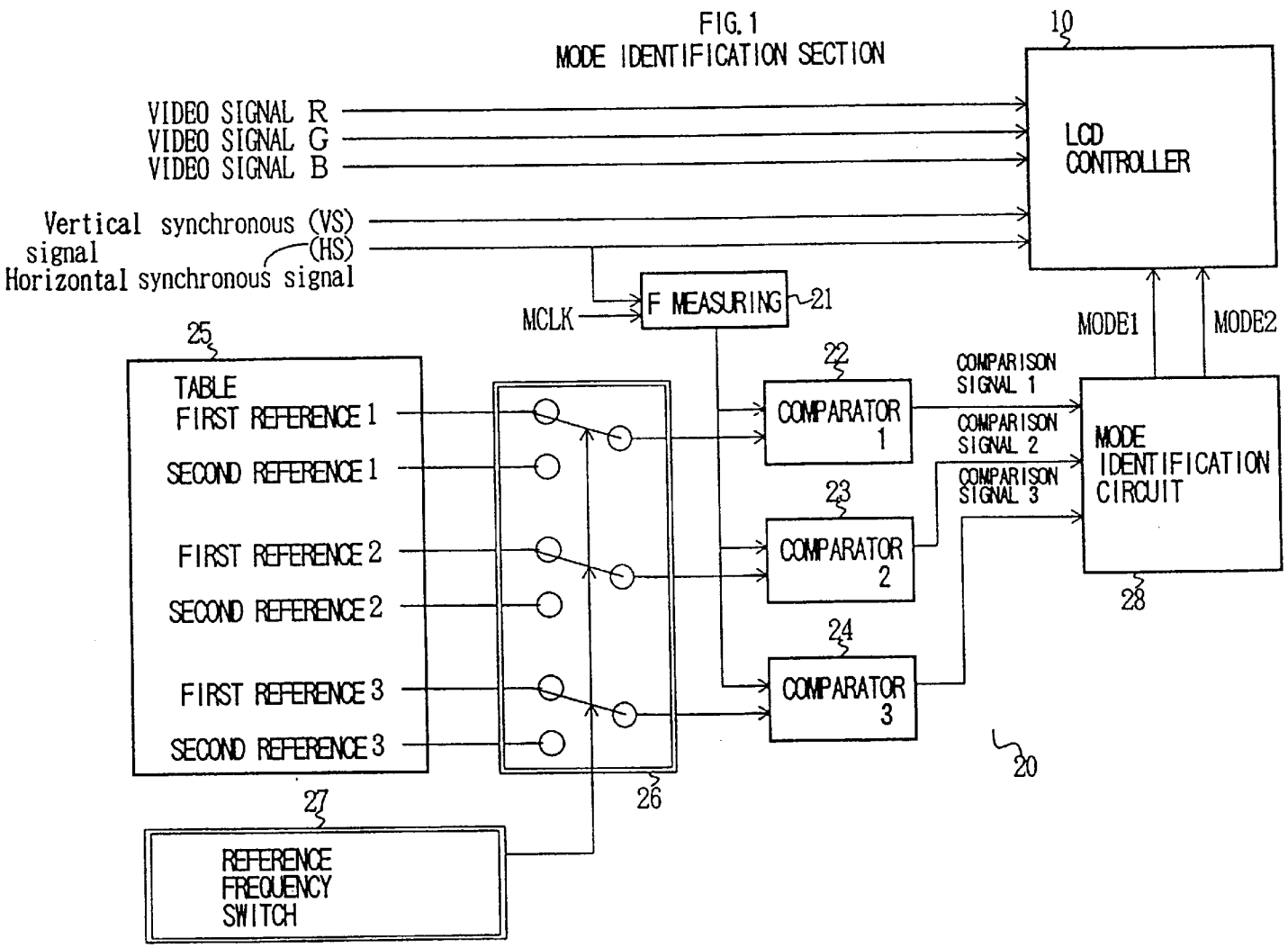
FIG. 1 is a block diagram illustrating an operational mode identification section according to a first embodiment.

The preferred embodiments of the present invention will now be explained by using a liquid crystal display device while referring to the drawings. The scope of the present invention, however, is not limited to the embodiments or the liquid crystal display device.

FIG. 1 is a block diagram illustrating a display operational mode identification section according to one embodiment of the present invention. RGB video signals, a vertical synchronous signal $V_S$, and a horizontal synchronous signal $H_S$ are supplied by a computer to a liquid crystal display controller 10 in a liquid crystal display device. FIG. 1 shows an example for identification of an operational mode based on the frequency of the horizontal synchronous signal $H_s$. The same arrangement can be applied for the identification of an operational mode by employing the frequency of a vertical synchronous signal $V_S$. Frequencies and cycles have a one-to-one correspondence, and therefore, since a cycle is substantially equivalent to a frequency, a frequency and a cycle are regarded equivalent in the following explanation.

A section in FIG. 1 other than the liquid crystal controller 10 is an identification section 20 for identifying an operational mode. In the identification section 20, first, a frequency measuring circuit 21 measures the frequency (or the cycle) of the received horizontal synchronous signal $H_S$. Specifically, the display device generates a clock MCLK for a display mode, and counts the number of clocks for one cycle of the horizontal synchronous signal $H_S$. In other words, the cycles corresponding to the frequency are counted. The clock MCLK for the display mode must have an appropriate frequency in accordance with the difference between a plurality of frequencies to be identified.

The obtained clock count is supplied to comparators 22, 23 and 24. A plurality of reference frequency (or cycle) sets for frequency identification are stored in a table 25 which is provided in a memory, etc. When the output of the frequency measuring circuit 21 is the clock count for one cycle, the clock counts corresponding to one cycle of the reference frequencies are entered in the table 25. A reference frequency select switch 27 is employed to select one of the reference frequency sets in the table 25. A select switch section 26 may also be so designed that an address in the table is selected by the switch 27.

The reference frequencies are compared with the measured frequency by the comparators 22, 23 and 24, and comparison signals 1, 2 and 3 are transmitted to a mode identification circuit 28. Assuming the comparison signal goes to level H when the measured frequency is lower than the reference frequencies, the signal levels of the comparison signals 1, 2 and 3, corresponding to modes A, B, C and D, are as shown in FIG. 2 showing the relationships between signals for operational mode identification. In other words, four different combinations of the comparison signals 1,2,3, are provided, depending on whether the measured frequency of the horizontal synchronous signal $H_S$ is higher or lower than the reference frequencies. In accordance with the combination of the comparison signals, the mode identification circuit 28 transmits the 2-bit mode signals MODE 1 and MODE 2 to the liquid crystal controller 10.

FIG. 3 is a table for explaining the reference frequencies for operational mode identification. As is shown in FIG. 1, according to this embodiment of the present invention, a plurality of reference frequency sets are prepared to identify the frequency of the measured horizontal synchronous signal $H_S$. In FIG. 3, two reference frequency sets are prepared. In the upper portion of the table in FIG. 3 is depicted an example where one cycle of the horizontal synchronous signal $H_S$ is employed as a reference, and in the lower portion is depicted an example where two times a cycle of the horizontal synchronous signal $H_S$ is employed as a reference.

According to the upper portion example, the first reference frequency (or cycle) indicates a value that is nearly in the middle of the adjacent frequencies of the modes. The switch in FIG. 1 is therefore set to select the first reference frequency as an initial value. The second reference frequency (or cycle) is set to a frequency slightly higher than (or to a cycle slightly shorter than) the first reference frequency (or cycle). When, for example, the frequency of the received horizontal synchronous signal $H_S$ is near the value that is nearly in the middle of the adjacent frequencies of the adjacent modes, and if the switch 27 in FIG. 1 selects the first reference frequency as the initial value, the outputs of the comparators are unstable and fluctuate between level H and level L. In this case, a computer operator observes the unstable condition of the screen, and adjusts the switch 27 to select the second reference frequency. Since the second reference frequency is a frequency obtained by shifting toward a higher value than the first frequency, the outputs of the comparators are not unstable.

The lower portion in FIG. 3 represents the first and the second reference frequencies when two cycles (½ frequency) of the horizontal synchronous signal $H_S$ are employed as a reference. When the frequency of clock MCLK for mode identification, which is generated by the display device, can not be set sufficiently high, the accuracy of the frequency measurement is deteriorated, and the outputs of the comparators may become unstable. In such a case, the frequency is measured by counting the number of clocks while two times a cycle is used as a reference, so that the above problem can be resolved. At this time also, the first reference frequency is a value that is nearly in the middle of the adjacent frequencies of the modes, and the second reference frequency is set higher than the first reference frequency.

FIG. 4 is a table for explaining the reference frequencies used for the identification of a display operational mode. In this example, when the frequency of a clock signal MCLK for mode identification is set to 20 MHz, the count values of the frequency measuring circuit 21 are shown that correspond to the respective reference frequencies. Since the frequency measuring circuit 21 asynchronously counts the horizontal synchronous signal $H_S$, an error equivalent to 1 or 2 clocks always occurs.

Suppose that a display signal for mode C is supplied by the computer. Since the frequency of the horizontal synchronous signal $H_S$ is 31.469 KHz and its cycle is 31.778 μsec, the count value output by the frequency measuring circuit 21 is 635. When the first reference frequency is selected by the reference frequency select switch 27, the count value shown in the table in FIG. 4 is transmitted to the comparators 22,23,24. As a result, the outputs of the comparators 1, 2 and 3 are levels H, H and L, respectively. According to the table in FIG. 2, the mode identification circuit 28 outputs the signals MODE 1 and MODE 2 at levels H and L as notification that the display mode is mode C. Since the horizontal synchronous signal $H_S$ has the normal frequency in mode C, even when the second reference frequency is selected, a display signal for mode C is also output.

Suppose that a horizontal synchronous signal $H_S$ of 33.1 KHz is transmitted by the computer. The count value of the frequency measuring circuit 21 is 604. Since it counts the clocks asynchronously, the count value always carries a difference of 1 or 2 clocks. If the first reference frequency is employed and when the count value is 604±1, the count value of the reference frequency 2 is also 604, so that the output of the comparator 2 becomes unstable and is level H or level L. As a result, the mode would be identified as mode C and as mode B. Besides the error in the count value, the frequency of the horizontal synchronous signal supplied by the computer sometimes fluctuates as a result of some external factor. In this case also, the result of the identification is unstable.

Therefore, as the operational mode is switched unstably, the number of horizontally and vertically arranged dots and the sampling clock frequency for each pixel fluctuate, and a screen display is degraded. In such a case, the second reference frequency is selected by the switch 27. Then, since, even with a fluctuation of the count value 604±1, the obtained count value is always greater than count value 594 of the reference frequency 2, the output of the comparator 2 can be stabilized at level H. Thus, the comparison signals are stable as H, H and L, and the display mode is identified as mode C. The screen display is not degraded due to the switching of an operational mode.

Figure 5:
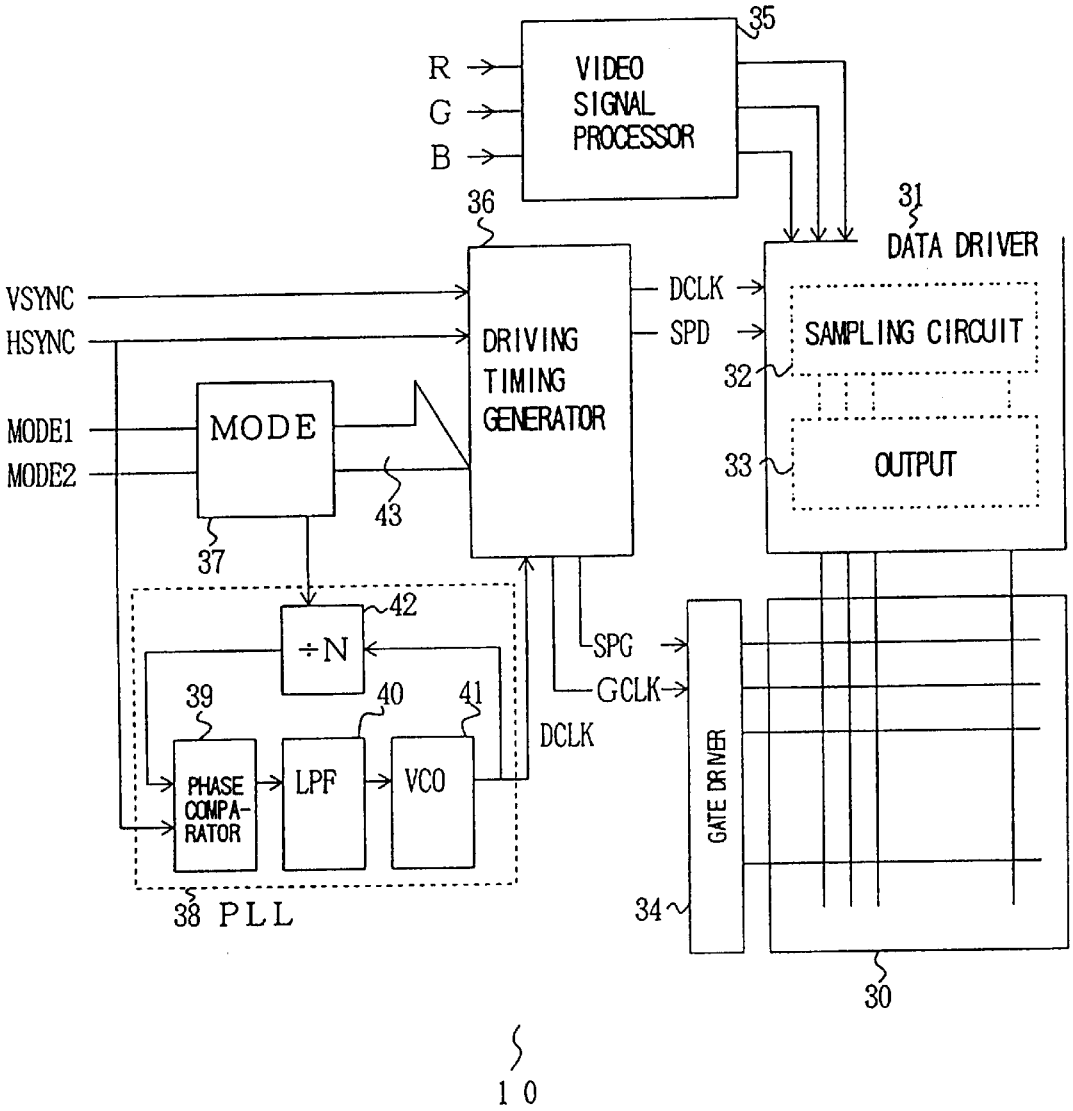
FIG. 5 is a schematic block diagram illustrating a liquid crystal display controller.

FIG. 5 is a schematic block diagram illustrating the liquid crystal controller 10. A data driver 31 for driving data bus lines, and a gate driver 34 for driving gate bus lines are connected to a liquid crystal display panel 30. A voltage corresponding to a video signal for each pixel is applied to the data bus lines, and the gate bus lines are sequentially scanned, so that a write voltage is applied to a pixel electrode at each of the intersections of the bus lines. In accordance with the applied voltage value, the molecules in the liquid crystal layer between the electrodes are rotated and the luminance of the pixels is expressed. For color display, the luminance of the RGB pixels is expressed.

Figure 9:
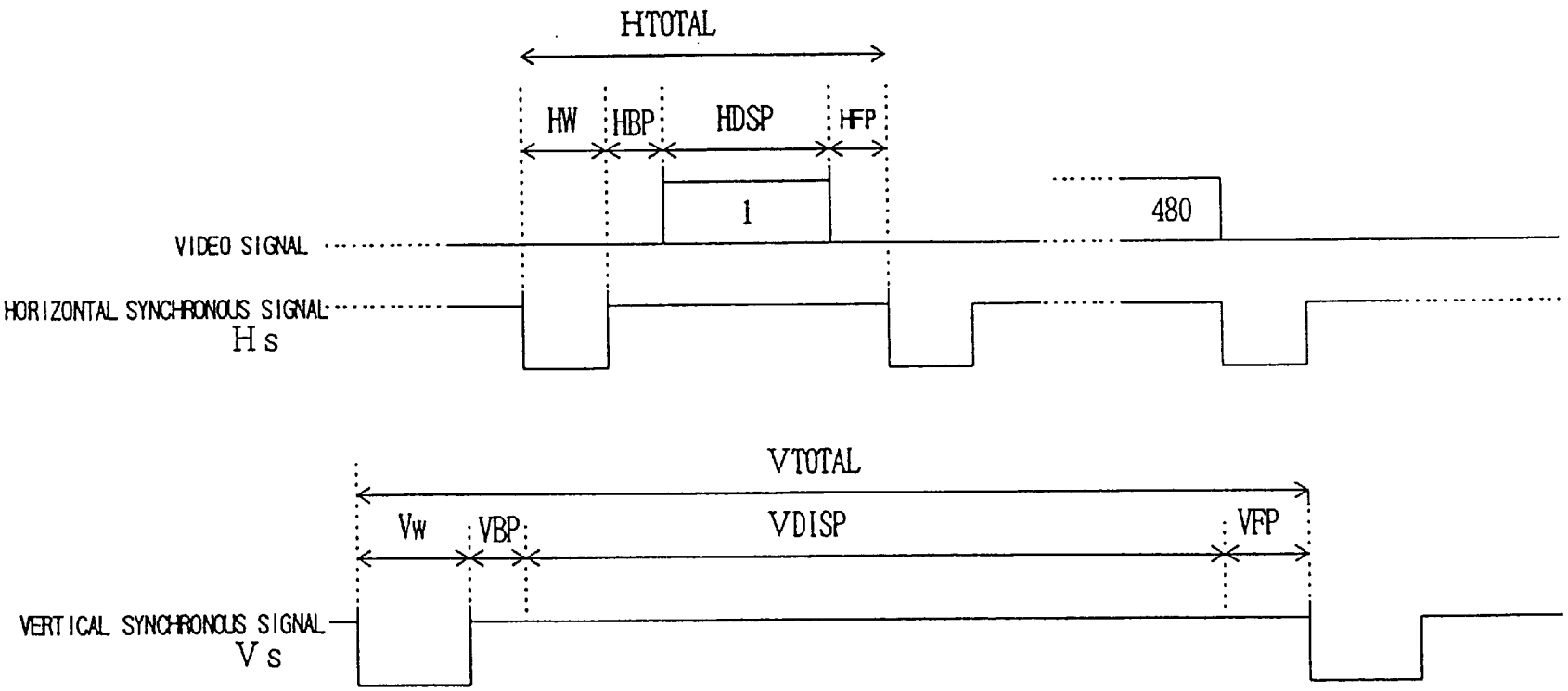
PRIOR ART FIG. 9
FIG. 9 is a signal waveform diagram for explaining the outline of display signals.

As is shown in FIGS. 9 and 10, the display operational mode for a display specifies the times for beginning and ending the horizontal synchronous signal $H_S$, the vertical synchronous signal $V_S$ and the video signal, and the dot clock frequency for determining the timing for the pixels (dots) of a video signal. Upon receipt of the mode output from the mode identification circuit 28 in FIG. 1, a mode setting section 37 in FIG. 5 transmits specified values shown in FIG. 10 to a driver timing generator 36 and a PLL circuit 38.

Since normally a computer does not supply a dot clock, the PLL circuit 38 in the display device generates a dot clock signal of N times the frequency that is synchronous with the horizontal synchronous signal $H_S$. The PLL circuit 38 basically comprises a phase comparator 39, a low-pass filter 40, a voltage controlled oscillator 41 and a 1/N frequency divider 42. The PLL circuit 38 removes a phase difference between a signal, for which the frequency is 1/N the frequency of the output clock DCLK, and the horizontal synchronous signal $H_S$, and thus generates a dot clock signal DCLK of N times the frequency that is synchronous with the horizontal synchronous signal $H_S$. The dot clock signal DCLK is employed as a sampling clock for an analog RGB video signal.

Therefore, the mode setting section 37 sends the frequency divider 42 in the PLL circuit 38 an N value corresponding to an identified mode. As a result, a dot clock signal DCLK corresponding to the mode is generated. The dot clock signal DCLK is transmitted to a driver timing generator 36. Based on the horizontal synchronous signal H, and the vertical synchronous signal $V_S$, the driver timing generator 36 employs the dot clock signal DCLK to control the timings. The timings shown in FIG. 9 can be generated by using the above three signals.

The video signal RGB is changed by a video signal processor 35 in accordance with the properties of a liquid crystal display panel, such as amplification, γ correction or polarity inversion. The resultant video signal is transmitted to the data driver 31. In the data driver 31, provided are at least a sampling circuit 32 and an output circuit 33 for outputting a voltage to the data bus lines. The dot clock signal DCLK and a start pulse SPD for a data driver are transmitted from the driver timing generator 36. Then, sampling of the video signal is performed at a predetermined timing for each identified display mode, and a write voltage for each pixel is supplied to the output circuit 33.

Similarly, a gate clock signal GCLK, for indicating the timing for the scanning of the gate bus lines, and a gate bus start signal SPG are transmitted to the gate driver 34. The gate clock signal GCLK has the same frequency as that of the horizontal synchronous signal $H_S$, for example. Therefore, the gate bus lines are scanned synchronously with the horizontal synchronous signal $H_S$.

Figure 6:
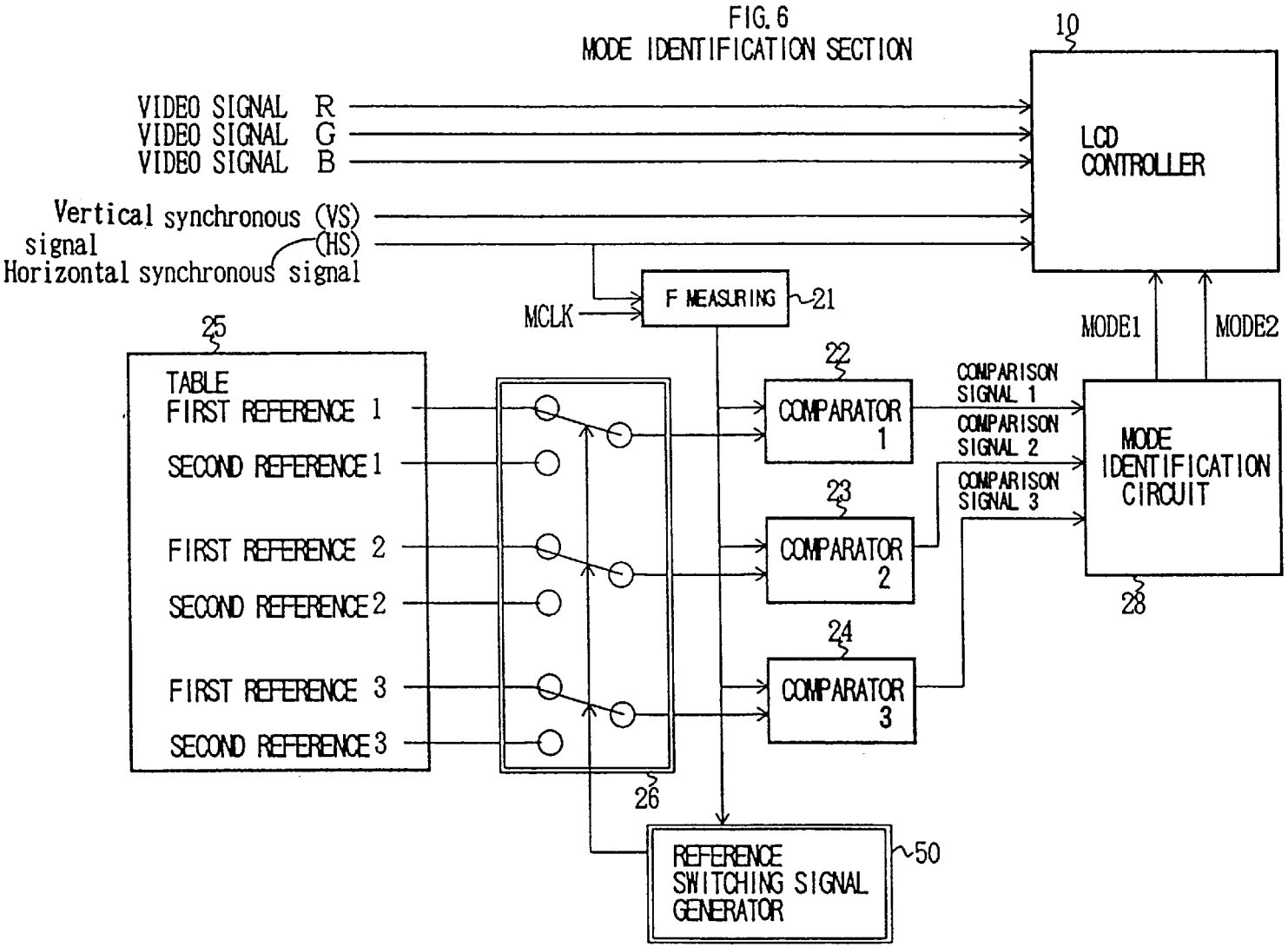
FIG. 6 is a block diagram illustrating an operational mode identification section according to a second embodiment.

FIG. 6 is a block diagram illustrating a display operational mode identification section according to a second embodiment. The same reference numerals as are used in FIG. 1 are used to denote corresponding or identical components. A difference between the first embodiment in FIG. 1 and the second embodiment is as follows. In the first embodiment, when the result of the mode identification is unstable, a computer operator observes the unstable condition of the screen display, and selects a reference frequency set by using the switch 27. In the second embodiment, a reference frequency selection signal generator 50 is provided for automatic selection.

The reference frequency selection signal generator 50 receives a count value from a frequency measuring circuit 21. When the count value is near the first reference frequency, for example, a selection signal is transmitted to a switch 26 to automatically select the second reference frequency. More specifically, a count value near the first reference frequency, which is a default value, is set in advance. When a count value obtained by the frequency measuring circuit 21 is within the range of the above count value, the second reference frequency is selected. As another example, a region for a count value near the first reference frequency and a region for a count value near the second reference frequency are set. When the count value of the frequency measuring circuit 21 falls in one of the nearby regions, the other reference frequency may be selected. In such a case, both nearby regions are adjacent to each other. When the count value of the frequency measuring circuit 21 does not belong to either region, any reference frequency can be employed to stably identify an operational mode.

FIG. 7 is a table for explaining reference frequencies for the display operational mode identification section in FIG. 6. In FIG. 7, the unstable operational regions are the above nearby regions. Count value regions, 546 to 554, 600 to 608, and 717 to 725, are set as nearby regions for three count values, 550, 604 and 712, for reference frequencies. When a count value falls in one of the regions, identification may be unstable due to various errors. Thus, when the count value of the frequency measuring circuit 21 falls in one of the nearby regions, the selection signal generator 50 supplies a selection signal to the switch 26 to automatically select the second reference frequency. The default value is set as the first reference frequency. The count values for the second reference frequency are values outside the unstable regions.

Figure 8:
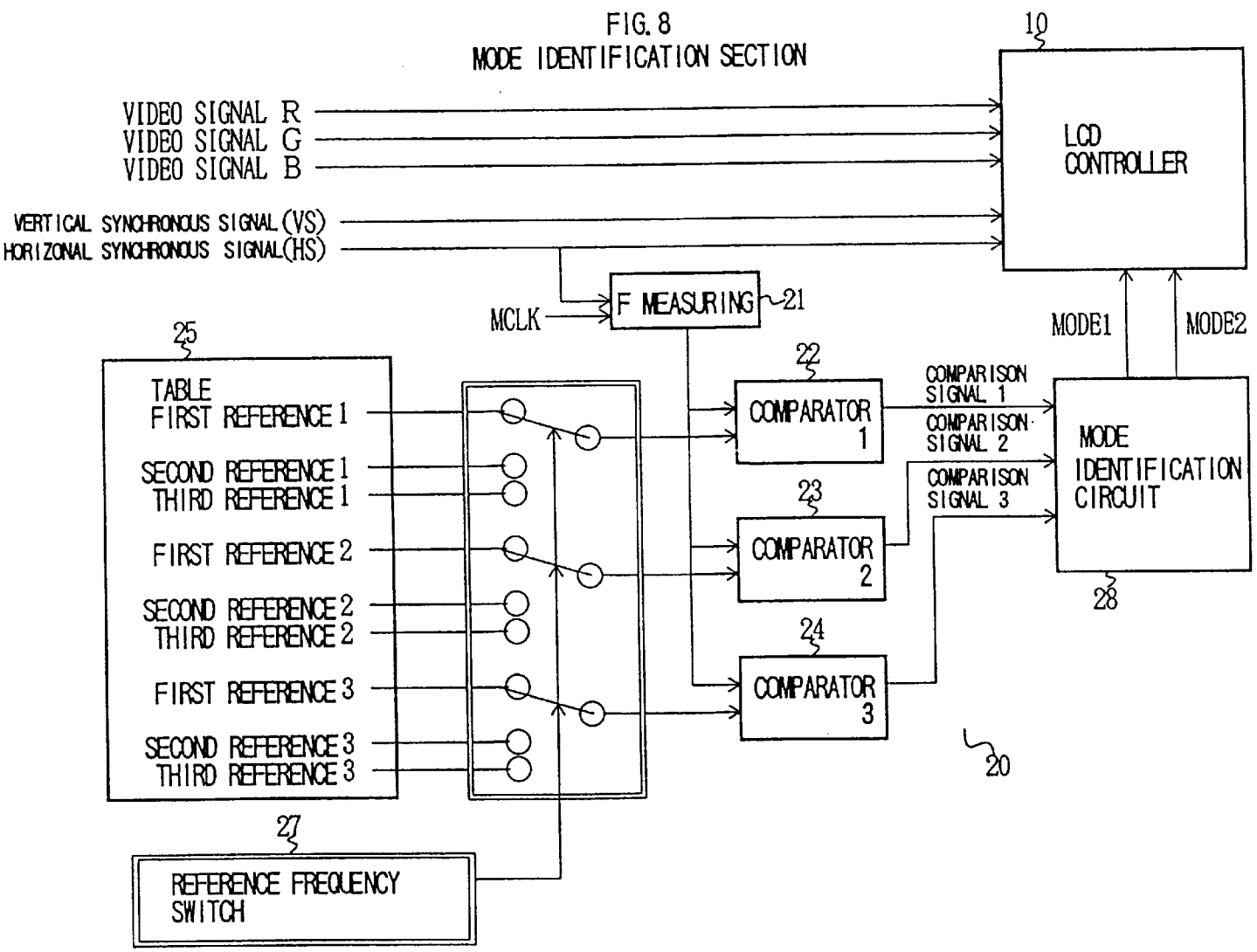
FIG. 8 is a block diagram illustrating an operational mode identification section according to a third embodiment.

FIG. 8 is a block diagram illustrating a display operational mode identification section according to a third embodiment. In the third embodiment, three sets of reference frequencies are employed. In the first and the second embodiment, as is shown in FIGS. 4 and 7, the first frequency is regarded as an intermediate value for the frequencies in the individual modes, and the second reference frequency is set higher than the first (lower cycle and lower count value). In the third embodiment, a third reference frequency is set that is lower than the first reference frequency (higher cycle and higher count value).

Suppose that the frequency of the input horizontal synchronous signal $H_S$ is 33.141 KHz or is near that value, and that a computer generates a video signal in mode B. Since the horizontal synchronous signal $H_S$ is near the first reference frequency 2, the identification of a display mode will be unstable if the first reference frequency is used. The second reference frequency is selected to identify the mode, and since the second reference frequency 2 is 33.698 KHz, the mode is identified as mode C. This was described previously. Although the operational mode is stable, this mode C is different from the mode B of the computer. Therefore, while the screen display is stable, an operator must employ adjustment means at the display device to adjust a frequency dividing count N for the PLL circuit, and a start signal for a data/gate driver.

Since in the third embodiment the third reference frequency is prepared, the third reference frequency is selected, so that a frequency lower than the first reference frequency can be used as a reference value. As a result, mode B is precisely identified. A computer operator need only change three switches sequentially to select an unstable screen display and an optimal display condition.

In the third embodiment as well as in the second embodiment, three reference frequency sets can be automatically switched as needed. For example, a nearby region higher than the first reference frequency and a nearby region lower than the first reference frequency are set. When the frequency falls in the higher nearby region, the third reference frequency, which is lower, is selected. When the frequency falls in the lower nearby region, the second reference frequency, which is higher, is selected.

Means for selecting one of a plurality of reference frequency sets as needed can be designed with a variety of structures, and is not limited to the above described embodiments. When, for example, the frequency of a received synchronous signal falls in the middle region between frequencies of individual modes, one of the modes nearby may be forcibly identified, without changing the reference frequency and performing a comparison. The display device is not limited to the liquid crystal display device, and may be a dot matrix type, such as a plasma display device. The present invention can be applied for a common CRT display device to identify a display mode in the same manner.

As is described above, according to the present invention, since display signals, including a horizontal synchronous signal and a vertical synchronous signal, which are transmitted from a computer, can be analyzed and a display operational mode can be identified, a problem involving degradation of image on a screen display can be easily resolved.

What is claimed is:

1. A display device, having a display screen, which receives display signals including at least a synchronous signal and a video signal transmitted at predetermined times relative to the synchronous signals and displays the video on the display screen, the display device comprising:

an identification section for measuring a frequency or a cycle of the synchronous signal and for comparing the frequency or the cycle with predetermined first and second reference frequencies or cycles to identify a display mode which specifies the predetermined timing from a plurality of display modes with predetermined settings, said predetermined reference frequency or cycle defining a dividing point among the range of frequencies or cycles from one display mode to another display mode of said plurality of display modes so that when said measuring frequency or cycle is identified as being greater than or less than said first or second reference frequency or cycle, said one or said another display mode is identified as the correct display mode to provide a stable display, said second reference frequency or cycle being set by controlling the identification section to selectively change the reference frequency or cycle from said first reference frequency or cycle to said second reference frequency or cycle within the range between the display modes when said first reference frequency or cycle results in unstable display.

2. A display device according to the claim 1, further comprising:

a dot clock generation circuit for generating a dot clock signal having a frequency in accordance with the display mode detected by the identification section; and a display controller for displaying a video signal through sampling the video signal based on the dot clock signal with a predetermined timing from said synchronous signal.

3. A display device according to the claim 1, wherein;

said identification section stores a first reference frequency or cycle between the frequency or cycle of the synchronous signals corresponding to the plural display modes and a second reference frequency or cycle of a frequency which is higher or lower than the first frequency, and the first and second reference frequencies or cycles are selectively switched.

4. A display device according to the claim 3, wherein:

said identification section selects the second reference for detecting the display mode when the frequency or cycle of the supplied synchronous signal is in a nearby region of the first reference.

5. The method according to claim 3, wherein said identification section stores a third reference frequency or cycle so that said first, second and third reference frequencies or cycles are selectively switched.

6. A display device according to one of the claims 1–4, said synchronous signal includes a horizontal synchronous signal or a vertical synchronous signal.

7. The display device according to claim 1, further comprising a switch so that a user can control said identification device to select the reference frequency or cycle upon detecting an unstable display.

8. The display device according to claim 1, further comprising a reference switching signal generator for automatically controlling said identification section to switch the reference frequency when use of said reference frequency or cycle is likely to cause unstable display.

9. The display device according to claim 8, wherein said reference switching signal generator receives a count value for said measured frequency and compares said count value to predetermined count values to determined if said reference frequency or cycle will cause unstable display.

10. A method of identifying a display mode of supplied display signals, comprising, the steps of:

measuring a frequency or cycle of a supplied synchronous signal, identifying the display mode for said supplied synchronous signal from a plurality of display modes with predetermined settings including a step of comparing said frequency or cycle to a first reference frequency or cycle set between said display modes;

comparing the frequency or cycle of the supplied synchronous signal with a predetermined second reference frequency or cycle that is different from said first reference frequency or cycle, said first and second reference frequencies and cycles being between the same two frequencies or cycles of two said display modes when detecting that the display is unstable, said unstable display indicating that said first reference frequency or cycle has a value too close to the value of said frequency or cycle of said supplied synchronous signal, said second predetermined reference frequency or cycle defining a dividing point so that when said frequency or cycle of said supplied synchronous signal is found to be greater than or less than said second predetermined reference frequency or cycle, one of said two display modes is chosen as the correct display mode for stable display.

11. The method according to claim 10, wherein said first reference frequency or cycle is set at a midpoint value between two cycles of each pair of adjacent display modes of said plurality of display modes, and said second reference frequency or cycle is set outside of said midpoint value and within said range of frequencies or cycles between each said pair of adjacent display modes.

12. A method of identifying a display mode with predetermined settings of supplied display signals including a supplied synchronous signal and video signal, comprising:

measuring a frequency or cycle of the supplied synchronous signal;

comparing the frequency or cycle of the supplied synchronous signal with one reference frequency or cycle which is a middle value between adjacent display modes; and comparing the frequency or cycle of the supplied synchronous signal with another reference frequency or cycle, which is different from the one reference frequency or cycle, to stably identify the display mode when a display mode is identified unstably when comparing the frequency or cycle of the supplied synchronous signal with said one reference frequency or cycle, said another frequency or cycle defining a dividing point in a range of frequencies or cycles defined from one said adjacent display mode to another said adjacent display mode so that when said frequency or cycle of the supplied synchronous signal is greater than or less than said another frequency or cycle, one of said adjacent display modes is chosen as the correct display mode for stable display.

13. A method for identifying a display mode with predetermined settings for a display device which received a synchronous signal and a video signal, comprising steps of:

measuring a frequency or cycle of the synchronous signal;

comparing the measured frequency or cycle of the synchronous signal with a first reference frequency or cycle to identify the display mode from a plurality of display modes; and changing the reference frequency or cycle including selecting one of a plurality of predetermined reference values to be used for the step of comparing when said first reference frequency or cycle results in unstable display, wherein said plurality of predetermined reference values are different from each other and are set in the range between the frequencies or cycles of two adjacent display modes of the plurality of display modes, said first reference frequency or cycle being set between said frequencies or cycles of said two adjacent display modes, said selected reference frequency or cycle defining a dividing point on the range of frequencies or cycles defined from one said adjacent display mode to another said adjacent display mode so that when said measured frequency or cycle is found to be greater than or less than said selected reference frequency or cycle, one of said adjacent display modes is chosen as the display mode for stable display.

* * * * *